United States Patent [19]

Holtrop

[11] 4,033,224

[45] July 5, 1977

[54] LIQUID PROPELLANT GUN

[75] Inventor: John W. Holtrop, Ridgecrest, Calif.

[73] Assignee: The United States of America as represented by the Secretary of the Navy, Washington, D.C.

[22] Filed: Sept. 16, 1976

[21] Appl. No.: 723,880

[52] U.S. Cl. ..... 89/7; 89/1 R

[51] Int. Cl.[2] ..... F41F 1/04

[58] Field of Search ..... 89/7, 1 R, 11

[56] References Cited

UNITED STATES PATENTS

| | | | |
|---|---|---|---|
| 2,981,153 | 4/1961 | Wilson et al. | 89/7 |
| 3,011,451 | 12/1961 | Griffin | 89/7 X |
| 3,138,990 | 6/1964 | Jukes et al. | 89/7 |
| 3,763,739 | 10/1973 | Tassie | 89/7 |
| 3,800,657 | 4/1974 | Broxholm et al. | 89/7 |
| 3,992,976 | 11/1976 | Bartels et al. | 89/7 |

*Primary Examiner*—David H. Brown
*Attorney, Agent, or Firm*—R. S. Sciascia; Roy Miller; Gerald F. Baker

[57] ABSTRACT

A liquid propellant gun featuring concentric propellant pump, valve and bolt. Forward movement of the bolt causes forward movement of the propellant pump by interconnection of ball detents. The valve is forced open by differential pressure and closed by abutment of pump surfaces. At this juncture the ball detent connection is relieved and the bolt continues forward to pressurize the propellant charge before firing.

10 Claims, 1 Drawing Figure

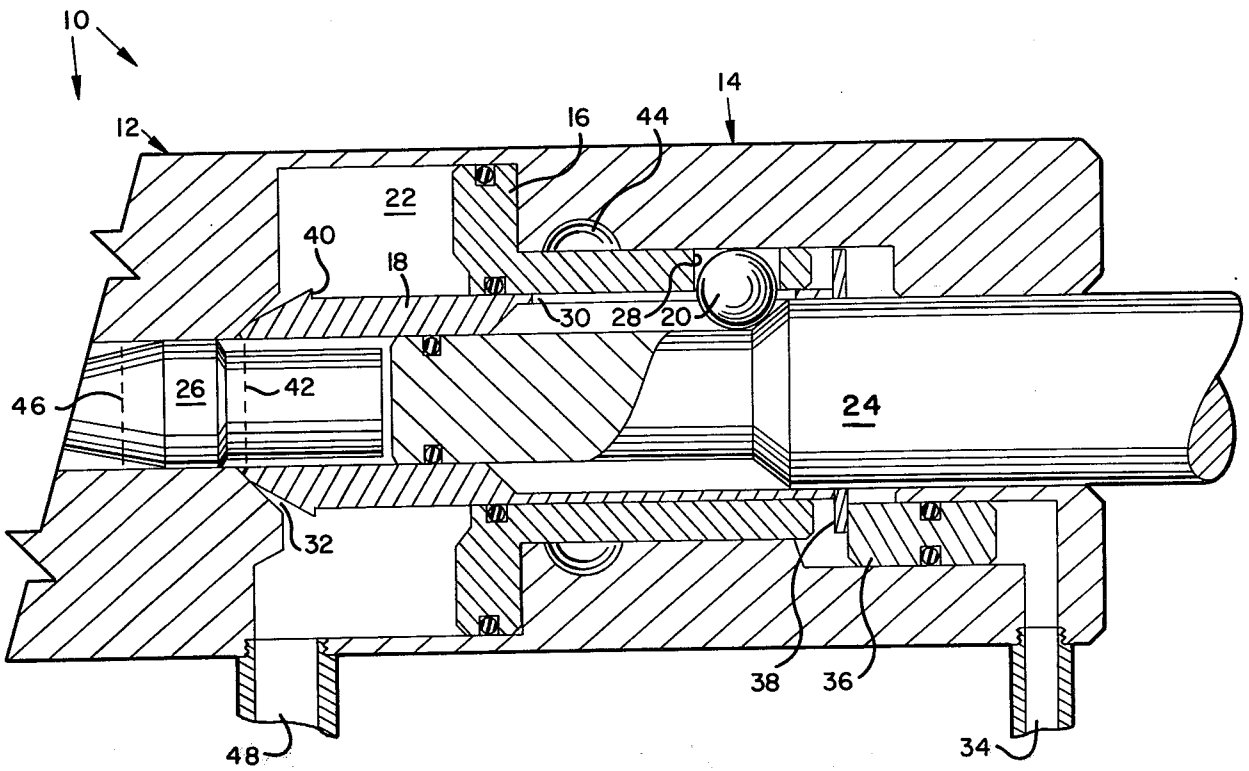
10
12
14
16
18
20
22
24
26
28
30
32
34
36
38
40
42
44
46
48

LIQUID PROPELLANT GUN

BACKGROUND OF THE INVENTION

The present invention relates to liquid propellant guns, and more particularly, to a liquid propellant gun which includes a mechanism for synchronizing propellant injection with bolt-action for rapid fire.

Previous known designs have used switches to sense position and individual actuators to position the bolt, open the injection valve, pump the propellant, and close the valve. This is unacceptably slow, complex, and unreliable for rapid fire action. One prior art device has a drum cam containing separate cam paths cooperating with separate followers for actuating the bolt, valve, and propellant pump. This arrangement, however, results in a very complex, cumbersome and expensive system.

SUMMARY OF THE INVENTION

The present invention provides apparatus usable in liquid propellant guns such as those described in assignee's prior copending applications Ser. No. 612,817, filed Sept. 12, 1975 now U.S. Pat. No. 3,992,976 and Ser. No. 613,690 filed Sept. 15, 1975.

The present invention relates to a valve, pump, and bolt combination wherein the propellant pump and valve member are interconnected by a ball detent, for example, and wherein the valve is forced open by differential pressure and automatically closed, for example by abutment of pump surfaces. Forward movement of the bolt, in the preferred embodiment, causes forward movement of the propellant pump through the interconnection of a ball detent. After injection, the ball detent connection is relieved and the bolt continues forward to pressurize the propellant charge and seat the projectile before firing.

BRIEF DESCRIPTION OF THE SEVERAL VIEWS OF THE DRAWING

The sole FIGURE illustrated on the drawing is a partial longitudinal cross-sectional view taken in the breech area of a propellant gun according to the present invention.

DESCRIPTION AND OPERATION

The breech area of a liquid propellant gun according to the present invention is generally indicated at 10 on the drawing. The components shown include a barrel portion 12 and an integral receiver 14. Contained within the barrel and receiver are a propellant pumping piston 16, a propellant control valve 18, and plurality of radially spaced synchronizing balls 20.

The firing cycle begins with the pump piston 16 in the position shown. The chamber 22 in front of piston 16 is full of propellant and the valve 18 is closed. A projectile 26 has been loaded through an opening (not shown) in receiver 14 through the relieved portion of valve 18 while the bolt was in its rearmost position. This operation may be better understood by reference to Patent No. 3,992,976 referenced above. The bolt 24 began the cycle by pushing projectile 26 into the injection position shown. The bolt stopped when it engaged the synchronizer balls 20, which are positioned in holes or bores 28 in the pump extension and confined in axial slots 30 provided in the body of valve 18.

When bolt 24 and pump member 16, locked together by the balls 20, are moved forward they cause pressurization of the propellant in chamber 22. A wedge shaped pumping area is formed between the tapered surface of the forward wall of chamber 22 and the tapered surface of the forward end of valve 18 is indicated at 32. Propellant pressure acts on the wedge shaped valve "pumping area" 32, causing the valve to open. The amount of pressure necessary to open the valve is determined by the contour of the "pumping area" and the closure force on the valve. The closure force is regulated by applying a constant hydraulic or pneumatic pressure through port 34 to a piston 36 which bears upons a flange 38 at the rear of the valve. When the valve opens, the bolt, ball and pump move forward, pumping propellant between the bolt and projectile.

Near the end of the injection, the pump piston 16 strikes a shoulder 40 on valve 18 forcing the valve closed. When the pump and valve are completely closed, chamber 22 is practically empty and the bolt nose is flush with the valve seat as indicated by dotted line 42. In this position, the balls are in line with the circumferential groove 44 in the receiver. The balls are pushed into this groove as the bolt then moves forward into firing position indicated by dotted line 46. This additional travel is designed to protect the injector valve and pump from breech pressure when the propellant is ignited.

After firing, the bolt is withdrawn allowing the synchronizer balls to drop out of their receiver groove 44 releasing the pump; fresh propellant is introduced through port 48 pushing the pump back to its original position and the assembly is in position to receive a new projectile. The cycle can then be repeated.

From the above it can be readily seen that this invention simplifies the synchronization problems inherent in liquid propellant guns. The multiple synchronizing balls control the position of the valve and pump under filling, pumping, and firing conditions, and maintain the required gun kinematics. The bolt is the only component which requires actuation from an external source.

The pump, valve, and synchronization mechanism may be contained within a single replaceable module allowing low-cost fabrication and easy maintenance. Further, since the synchronizer balls hold the valve and pump locked closed and empty whenever the bolt is in the firing position, the quantity of propellant present and thus the danger of damage is minimized in case of a casualty.

Although only one embodiment of the invention has been described and illustrated, it should be mentioned that pumping forces on the bolts may be relieved by slight modifications of the system. One suggested modification comprises a hydraulic pump actuator built into the receiver which may be actuated by a signal from the bolt to help move the propellant pump. This arrangement removes some of the load from the synchronizer balls during the injection cycle. Also, the closure pressure through port 34, may be relieved upon a signal from the bolt movement, venting the pressure at that point, thus allowing the valve to be popped open substantially without resistance. This arrangement reduces pumping loads both on the bolt and the synchronizer balls.

Alternatively, the balls can be arranged to strike the end of the valve slot 30 to close the valve, thus eliminating the need for shoulder 40 on valve body 18. Another option for closing the valve would be to slow the bolt toward the end of the injection cycle and allow the closure piston 36, to close the valve. Further, a combination of the last two alternatives has been suggested.

What is claimed is:

1. In a liquid gun having a barrel, a receiver, a chamber, a bolt slidably mounted in said receiver and chamber for reciprocating motion along the axis of said barrel, and means for injection of fuel for firing a round from said barrel, the improvement comprising:

valve means in said receiver cooperating with said bolt for controlling access of fuel to said chamber;

pump means in said receiver coaxial with said bolt and cooperating with said valve means and said bolt to pressurize fuel in said chamber.

interconnecting means linking said valve means and said pump means and responsive to action of said bolt to effect injection of fuel from said chamber to a position between the bolt and the round.

2. The liquid propellant gun of claim 1 wherein said interconnecting means comprises a sphere confined in a closely fitting opening in said pump means and riding in an elongated slot in said valve means.

3. The liquid propellant gun of claim 1 wherein said interconnecting means comprises at least one detent member slidably mounted in a bore in said pump means and including a portion thereof riding in a slot in a portion of said valve means.

4. The liquid propellant gun of claim 1 wherein said valve means is biased to a closed position by a constant fluid pressure.

5. The liquid propellant gun of claim 4 wherein said interconnecting means comprises at least one detent member slidably mounted in a bore in said pump means and including a portion thereof riding in a slot in a portion of said valve means.

6. The liquid propellant gun of claim 5 and each said detent member being a metal sphere.

7. The liquid propellant gun of claim 1 further including:

a first tapered surface forming a portion of the forward wall of said chamber in line with the forward end of said valve means; and a second tapered surface on the forward end of said valve means;

said tapered surfaces being at slightly differing angles to the longitudinal axis of the barrel so as to form a wedge shaped pumping area;

whereby, when propellant is forced into said chamber, pressure building up in said pumping area will cause opening of said valve means.

8. The liquid propellant gun of claim 7 wherein said valve means is biased to a closed position by a constant fluid pressure.

9. The liquid propellant gun of claim 7 wherein said interconnecting means comprises at least one detent member slidably mounted in a bore in said pump means and including a portion thereof riding in a slot in a portion of said valve means.

10. The liquid propellant gun of claim 9 and each said detent member being a metal sphere.

* * * * *